United States Patent [19]

Ohishi

[11] Patent Number: 4,887,343

[45] Date of Patent: Dec. 19, 1989

[54] METHOD AND APPARATUS FOR ROLLER LEVELER

[75] Inventor: Hirohiko Ohishi, Shizuoka, Japan

[73] Assignee: Fuji Photo Film Co., Ltd., Kanagawa, Japan

[21] Appl. No.: 199,722

[22] Filed: May 27, 1988

[30] Foreign Application Priority Data

May 29, 1987 [JP] Japan ..... 62-131508
May 29, 1987 [JP] Japan ..... 62-131509
May 29, 1987 [JP] Japan ..... 62-131510

[51] Int. Cl.[4] ..... B21D 1/02

[52] U.S. Cl. ..... 29/445; 29/33 B; 29/33 S; 72/12; 72/16; 72/164; 228/5.7; 228/158; 364/472

[58] Field of Search ..... 72/12, 16, 164, 240, 72/14; 228/9, 158, 5.7; 29/33 B, 33 Q, 33 S, 445; 364/472

[56] References Cited

U.S. PATENT DOCUMENTS 3,180,122 4/1965 Evans et al. ..... 72/14
3,279,050 10/1966 Simich ..... 29/445
3,395,559 8/1968 Ungerer ..... 72/164
3,750,437 8/1973 Fuji et al. ..... 72/12
3,771,215 11/1973 Williams et al. ..... 228/5.7
3,835,681 9/1974 Shumaker ..... 228/5.7
3,852,983 12/1974 Cook ..... 72/12
4,142,237 2/1979 Yamasaki ..... 228/5.7
4,335,435 6/1982 Miura ..... 72/12

FOREIGN PATENT DOCUMENTS 2061929 6/1971 France ..... 72/16
117157 10/1976 Japan .
9983 4/1979 Japan ..... 72/12
91620 11/1981 Japan .
158206 12/1981 Japan ..... 72/16
38318 4/1983 Japan .
99022 1/1984 Japan .
94513 5/1984 Japan ..... 72/12
227913 11/1985 Japan ..... 72/240
9122 1/1986 Japan .

*Primary Examiner*—Daniel C. Crane
*Attorney, Agent, or Firm*—Sughrue, Mion, Zinn, Macpeak & Seas

[57] ABSTRACT

In a roller leveler having a number of work rollers, an improvement is proposed when a junction of metal web passes. Position detecting circuitry detects the junction of the metal web to output a detection signal. In response to the detection signal, an arithmetic unit applies an instruction signal to a depression control unit so that an amount of adjustment to be given to the metal web in the roller leveler is controlled to a suitable value.

9 Claims, 3 Drawing Sheets

METHOD AND APPARATUS FOR ROLLER LEVELER

BACKGROUND OF THE INVENTION

The present invention relates to a roller leveler in which a metal web or strips made of steel, stainless steel, aluminum or the like and having an uneveness refined by a large number of work rollers. The present invention particularly relates to a roller leveler and an automatic depression control unit therefor effective to prevent defects in an aluminum supports used for lithographic printing plates (PS plates) due to extraneous substances having entered into the roller leveler.

In generally-applied roller levelers, a large number of work rollers of small diameter alternately pinch the metal web or strips on the top and bottom thereof to convey the web and repeatedly bend it. As a result, the internal stress in the whole metal web is reduced and distributed and the metal web is flattened and straightened.

Heretofore, in a roller leveler, as shown in FIG. 1, upper work rollers 8 and lower work rollers 9 are depressed to plastically deform a metal web S to flatten the web S. In this operation, the amount of adjustment of depression is controlled according to various factors such as the material, thickness and width of the metal web.

When it is necessary to adjust the shape of a number of metal webs continuously, these metal webs are joined together into a series of metal webs manually (by the operator) or automatically by an automatic metal web joining device upstream of the roller leveler in the roller leveler line. In refining or flattening the series of metal webs with the roller type leveler, sometimes the depression applied to one metal web is not suitable for the next one; that is, it is necessary to change the depression separately depending on the metal webs to be flattened. In this case, the leveling line is operated at low speed, and the operator changes the depression after confirming the passage of the junction of the metal web through the roller leveler.

However, the method is deficient in that, after the passage of the junction through the roller leveler, the amount of adjustment of depression is liable to be set to a value unsuitable for the next metal web in sequence, so that the method produces unsatisfactorily flat metal webs, and a low yield. Also, the method suffers from low productivity because of the low speed operation.

Furthermore, in the generally-applied roller leveler, before metal webs are connected to one another upstream of the roller leveler, sometimes the metal webs are cut crosswise to increase the mechanical strength at the junctions of the metal webs. In this case, the metal webs may have burrs or may be bent, or chips formed in cutting the metal webs may stick to the metal webs.

On the other hand, the roller leveler employs metal work rollers having a hard surface. Therefore, if, as was described above, the metal plates have burrs or are bent, or chips formed in cutting the metal webs stick to the work roller, then the surfaces of the work rollers may be damaged. Furthermore, if extraneous substances such as powdered metal or dust, which are brought into the roller leveler on the metal web, or chips, which are created during correction of the unevenness of the metal web cling to the surface of the work roller, the surface of the work roller may be damaged so as to cause a defect in the surface of the metal web. Alternatively, the diameter of the work roller may be made non-uniform to render the linear velocity of the metal web and the circumferential velocity of the work roller unequal to the each other. Typical of such defects are band flaws, scratches, the clinging of the extraneous substance, side edge wrinkles and improper luster. As a result, the quality of the metal web is deteriorated, such defects on the surface of an aluminum web used to manufacture a lithographic printing plate (PS plate), create serious problems from the viewpoint of the quality and yield of the product.

As countermeasures against these problems of the generally-applied roller leveler, there have been developed a device for shot-blasting the work rollers, as disclosed in Japanese Utility Model Application (OPI) No. 9122/86 (the term "OPI" as used herein means "unexamined published application"), Japanese Utility Model Application (OPI) No. 38318/83 and Japanese Utility Model Application (OPI) No. 99022/84, a device for replacing the work rollers, as disclosed in Japanese Utility Model Application (OPI) No. 91620/81, and a wet leveling method in which a washing liquid is supplied in the process of correcting the unevenness of the metal web to reduce the occurrence of defects, as disclosed in Japanese Patent Application (OPI) No. 117157/76.

However, periodically shot-blasting or replacing the work rollers has a drawback in that it greatly decreases the efficiency of the process of correcting the unevenness. Supplying a washing liquid in the process has a drawback in that the washing liquid adversely affects a coating layer provided on the surface of the metal web especially a coating layer provided on an aluminum support for lithographic printing plate (PS plate), deteriorating the quality of the product.

SUMMARY OF THE INVENTION

In view of the foregoing deficiencies, one object of this invention is to provide a roller leveler having an automatic depression control unit which improves the yield which otherwise is affected by the unsatisfactory adjustment. The depression control unit also eliminates the need for low speed operation, and allows the roller leveler to flatten the metal web in a highly productive manner.

Another object of the invention is to provide a roller leveler having an automatic depression control unit which minimizes the reduction of work efficiency caused by the need to clean or replace the work rollers, and which prevents the surfaces from being damaged.

The foregoing and other objects of the invention have been achieved by a roller leveler comprising: junction detecting means provided on a roller leveler line; an arithmetic unit for processing signals output by the junction detecting means; and a depression control unit for controlling the amount of adjustment given to a metal web by a roller leveler.

More specifically, a roller leveler comprises: a number of work rollers; and a connecting unit located upstream of the rollers. The leveler further comprises: junction detecting means provided on a roller leveler line; an arithmetic unit for providing an instruction signal for changing, in response to a signal output from the junction detecting means, an amount of adjustment given to a metal web by the roller leveler; and a depression control unit for controlling the amount of adjustment in response to the instruction signal provided by the arithmetic unit.

In the leveler according to the invention, the junction detecting means detects the position of the junction, the arithmetic unit calculates a suitable amount of adjustment to be given to the metal web in the roller leveler, and the depression control unit automatically controls the amount of adjustment. Therefore, the leveler of the invention is free from the difficulties that a low speed operation must be carried out for detection of the junction of metal web, and that the yield is lowered because of an unsuitable amount of adjustment being given to the metal web.

Furthermore, according to the invention, junction detecting means for detecting the position of the junction of metal web on a roller leveler line inform an arithmetic unit of the position of the junction of metal web. According to the position of the junction of metal web, the arithmetic unit applies an instruction signal to an adjustment contact unit for moving the work rollers away from the metal web in the roller leveler or for causing the work rollers to suitably depress the metal web, to perform automatic depression control.

That is, another object of the invention is to provide an automatic depression control method for a roller leveler, in which position detecting means detects the position of the junction of metal web on a roller leveler line, to provide a detection signal which is applied to an arithmetic unit. The arithmetic unit applies an instruction signal to a depression control unit to move the work rollers of a roller leveler away from the metal web in the roller leveler when the junction of metal web goes into the roller leveler. The arithmetic unit applies an instruction signal to the depression control unit to cause the work rollers to suitably depress the following metal web when the junction of metal web passes through the roller leveler. The depression control unit operates automatically in response to the instruction signals.

In the method, the junction detecting means can positively detect the position of the junction of metal web on the roller leveler line. When the junction of metal web goes into the roller leveler, the arithmetic unit outputs the instruction signal to move the work rollers away from the metal web in the roller leveler, and in response to the instruction signal the depression control unit automatically moves the upper work rollers and/or the lower work rollers away from the metal web in the roller leveler. Accordingly, the chips formed in cutting the metal web will never stick to the surfaces of the work rollers, and therefore the surfaces of the metal web will never be damaged by such chips.

Furthermore, when the junction of metal web has passed through the roller leveler, the arithmetic unit outputs an instruction signal for pressing the metal web with an amount of adjustment calculated from various factors such as the material, thickness and width of the metal web. The depression control unit operates according to the instruction signal. Thus, according to the invention, the yield and the productivity are greatly improved.

BRIEF DESCRIPTION OF THE DRAWINGS

The nature, principle and utility of the invention will become more apparent from the following detailed description when read in conjunction with the accompanying drawings, in which.

DETAILED DESCRIPTION OF THE PREFERRED EMBODIMENTS

Preferred embodiments of the invention will be described with reference to the accompanying drawings; however, it should be noted that the invention is not to be considered as limited thereby.

Figure 1:
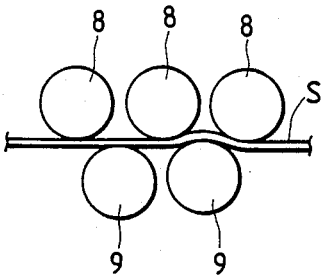
FIG. 1 is an explanatory diagram describing a general method of refining metal web with a roller leveler.
Figure 2:
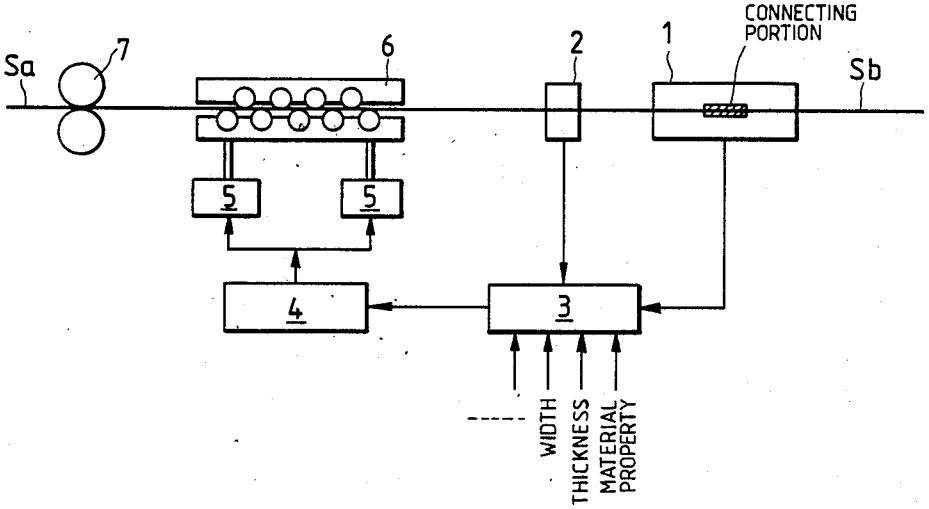
FIG. 2 is an explanatory diagram outlining the arrangement of a first example of a roller leveler according to this invention.

FIG. 2 shows a first example of a roller leveler according to the invention. In the device, a metal web Sa is flattened with an amount of adjustment which is predetermined according to the type, thickness and width of the material. The metal web Sa is connected to another metal web Sb with a connecting unit 1. When the metal webs Sa and Sb have been joined together, the connecting unit 1 applies a connection completion signal to an arithmetic unit 3, so that a roller leveler line starts. Upon starting of the roller leveler line, a length measuring unit 2 for measuring the length of a metal web supplies a signal corresponding to the feed length of the metal web Sa and Sb to the arithmetic unit 3.

The length measuring unit 2 measures the length of a metal web and informs the arithmetic unit of the arrival of the junction of the metal web to the inlet or outlet of the roller leveler or to the midpoint between the inlet and the outlet.

The arithmetic unit 3 calculates a suitable amount of adjustment to be employed by the roller leveler according to the material, width and thickness of the metal web to be connected to one another, and in response to the output signals of the length measuring unit and the connecting unit and other signals, applies an instruction signal to a depression control unit 4 to change the amount of adjustment. In response to the instruction signal from the arithmetic unit 3, the depression control unit 4 controls depression adjusting units 5 which operate the roller leveler 6.

The arithmetic unit 3 controls the output signal of the length measuring unit 2. When the feed length becomes equal to the pass length of a metal web between the connecting unit 1 and the roller leveler 6, the arithmetic unit 3 applies a signal to the depression control unit 4 to change the amount of adjustment predetermined for the metal web Sb. In response to the signal from the arithmetic unit 3, the depression control unit 4 controls the depression adjusting units 5, so that in the roller leveler 6 the amount of adjustment of the metal web Sa is changed over to the amount of adjustment of the metal web Sb.

The order of processing metal web according to the production plan, and data affecting the amounts of adjustment for the metal web (material, thickness and width) are loaded previously in the arithmetic unit 3. In accordance with these conditions, the arithmetic unit 3 provides amounts of adjustment necessary for the metal web.

The time instant for changing the amount of adjustment may occur before, during or after passage of the junction through the roller leveler, and is determined according to the operating conditions of the roller leveler.

As described above, the roller leveler includes a number of work rollers for refining metal web, and a connecting unit located upstream of the roller leveler, and further comprises: a length measuring unit provided between the connecting unit and the roller leveler, for measuring the length of a metal web up to the point at which the junction of metal web reaches the roller leveler; an arithmetic unit for providing an instruction signal for changing the amount of adjustment at the roller leveler according to the output signal bf the length measuring unit; and a depression control unit for controlling the amount of adjustment in response to the instruction signal from the arithmetic unit, so that, in the roller leveler, the amount of adjustment is automatically controlled.

As a result, in contrast to known approaches, the metal web following the junction is sufficiently flattened by a suitable adjustment. Furthermore, when the amount of adjustment changes, it is unnecessary to operate at low speed, so that the productivity is improved. In addition, it is unnecessary for the operator to detect the passage of the junction of metal web through the roller leveler in order to change the adjustment data so that the work burden on the operator is greatly relieved.

In the above-described roller leveler, when the connecting unit 1 is provided with a cutter so that the metal web Sa and Sb are cut widthwise by the cutter and are joined to each other by the connecting device 1, it is preferable to employ the following automatic depression control method, as now will be described with reference to FIGS. 2 and 3.

In FIG. 2, the metal web Sa is being refined, with the amount of adjustment predetermined in accordance with the type of material, width and thickness. The metal webs Sa and Sb are cut widthwise by the cutter provided for the connecting unit, and are connected into a series of metal web by the connecting unit 1. When the metal webs Sa and Sb are connected in this manner, the connecting unit 1 applies a connection completion signal to the arithmetic unit 3, whereupon the operation of the roller leveler line begins. Then, the length measuring unit 2 for measuring the length of a metal web applies the signal corresponding to the feed length of the metal web Sa and Sb to the arithmetic unit 3. The arithmetic unit 3 controls the output signal of the length measuring unit 2. When the feed length becomes equal to the pass length between the connecting unit 1 and the roller leveler 6, in the roller leveler 6, the lower work rollers are moved 100 mm away from the metal web.

When the feed length becomes equal to the sum of the pass length and the length of the roller leveler 6, the arithmetic unit 3 applies an output signal to the depression control unit 4 to change the amount of adjustment to the amount of adjustment predetermined for the metal web Sb. The unit 4 controls the depression adjusting units 5, so that in the roller leveler 6 the amount of adjustment predetermined for the metal web Sa is switched over to the amount of adjustment predetermined for the metal web Sb.

Figure 3:
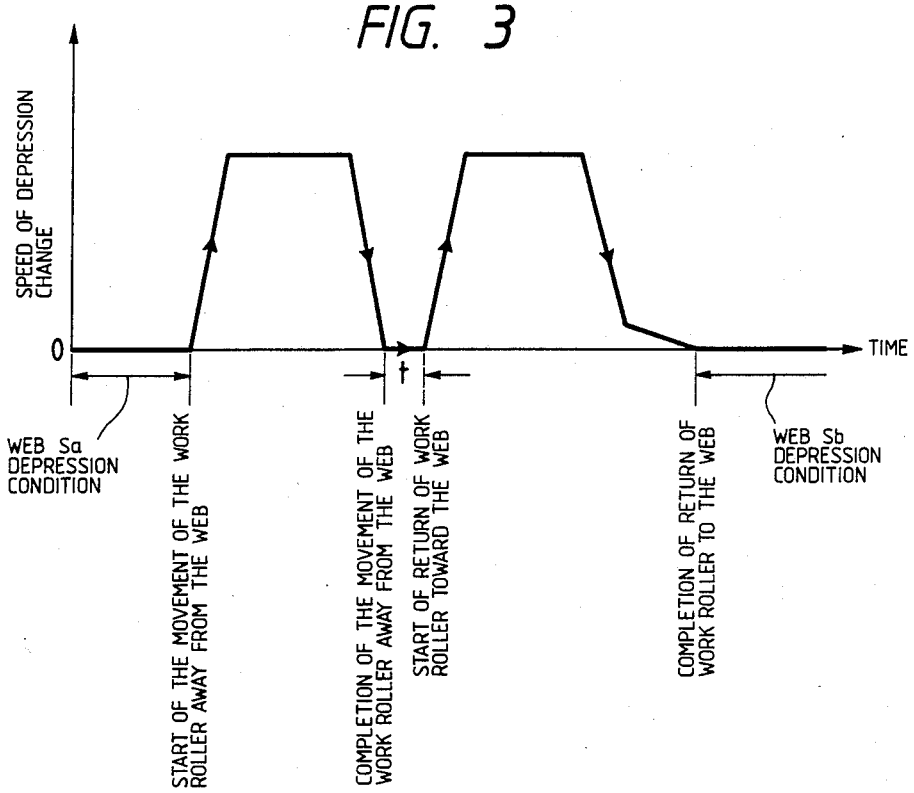
FIG. 3 is a graphical representation indicating adjustment variation with time in a depression control method for the roller leveler of FIG. 1.

FIG. 3 shows variation in adjustment of the lower work rollers with time. The depression adjusting units, in which the adjustment data for the metal web Sa has been loaded, cause the work rollers to move away from the metal web in response to the output signal of the arithmetic unit when the junction reaches the inlet of the roller leveler. In this operation, the work rollers are moved to a spaced position (100 mm below the metal plate).

The work rollers are held there for a predetermined period of time t during which the junction passes through the roller leveler, and are then returned to their original position, and in response to the output signal of the arithmetic unit 3 the amount of adjustment is switched over to the amount of adjustment for the metal web Sb. In this operation, if the work rollers are abruptly brought into contact with the metal web, then the web may be bent or the tension given to the metal web may be changed abruptly so that the junction may be broken. Therefore, the work rollers are returned slowly, with adjustment being changed gradually.

The movement of the work rollers effected upon arrival of the junction depends on the connecting method; however, the lower work rollers and/or the upper work rollers are moved away from the metal web.

The length measuring unit detects the position of the junction before it comes to the roller leveler, and applies the detection signal to the arithmetic unit. The arithmetic unit applies an instruction signal to the depression control unit to move the work rollers away from the metal web in the roller leveler when the junction reaches the inlet of the roller leveler, and applies an instruction signal to the depression control unit to cause the work rollers to depress the metal web suitably when the junction has passed through the roller leveler. Thus, the depression control unit is automatically operated. This automatic depression control method can substantially eliminate damage to the surfaces of the work rollers caused by the burrs or bends at the junction of metal web, and quality of the metal web, preventing defects caused by chips stuck to the surfaces of the work rollers. Furthermore, the method can decrease the period in which the work rollers need to be cleaned or replaced. In particular, the yield and the productivity of aluminum web used as the supports of pre-sensitized photo-sensitive materials can be greatly improved according to the invention.

Now, a second example of the roller leveler according to the invention will be described with reference to FIGS. 4 and 5, in which parts corresponding functionally to those which have been described with reference to FIGS. 2 and 3 are designated by the same reference numerals or characters.

In the second example of the roller leveler, instead of the length measuring unit in the first example (FIG. 2), position detecting means for detecting the junction of metal web are provided; more specifically, junction detecting units **2'*a* and 2'*b* are provided at the inlet and the outlet of the roller lever 6**, respectively.

Figure 4:
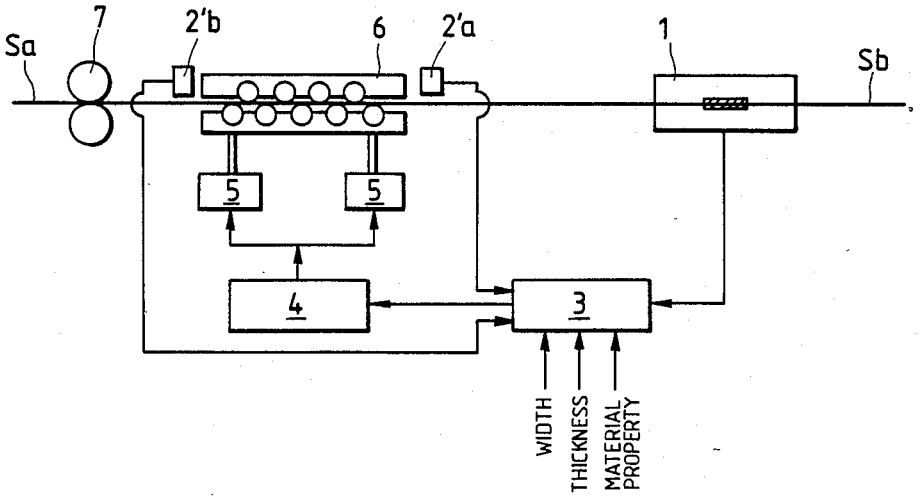
FIG. 4 is an explanatory diagram outlining the arrangement of a second example of the roller leveler according to the invention.

In FIG. 4, a metal web Sa is refined with an amount of adjustment determined the type of material, its width and its thickness. After being cut widthwise by the cutter provided for the connecting unit 1, the metal web Sa and another metal web Sb are joined into a series of metal webs by the unit 1. Upon connection of the two metal webs Sa and Sb, the connecting unit 1 applies a connection completion signal to the arithmetic unit 3, whereupon the operation of the roller leveler is started. After the device is started, when the junction of the two metal webs Sa and Sb reaches the junction detecting unit 2'a, the unit 2'a applies a detection signal to the arithmetic unit 3 to inform it of the arrival of the junction detecting unit 2'a. The junction detecting units 2'a and 2'b may be either of contact type or of non-contact type.

In response to the detection signal from the junction detecting unit 2'a, the arithmetic unit 3 applies an instruction signal to the depression control unit 4, so that depression setting units 5 move the lower work rollers 100 mm away from the metal web in the roller leveler 6.

When the junction is detected by the junction detecting unit 2'b at the outlet of the roller leveler 6, the depression setting units 5 cause the lower work rollers to return, and the amount of adjustment is changed to the amount of adjustment predetermined for the metal web Sb.

Figure 5:
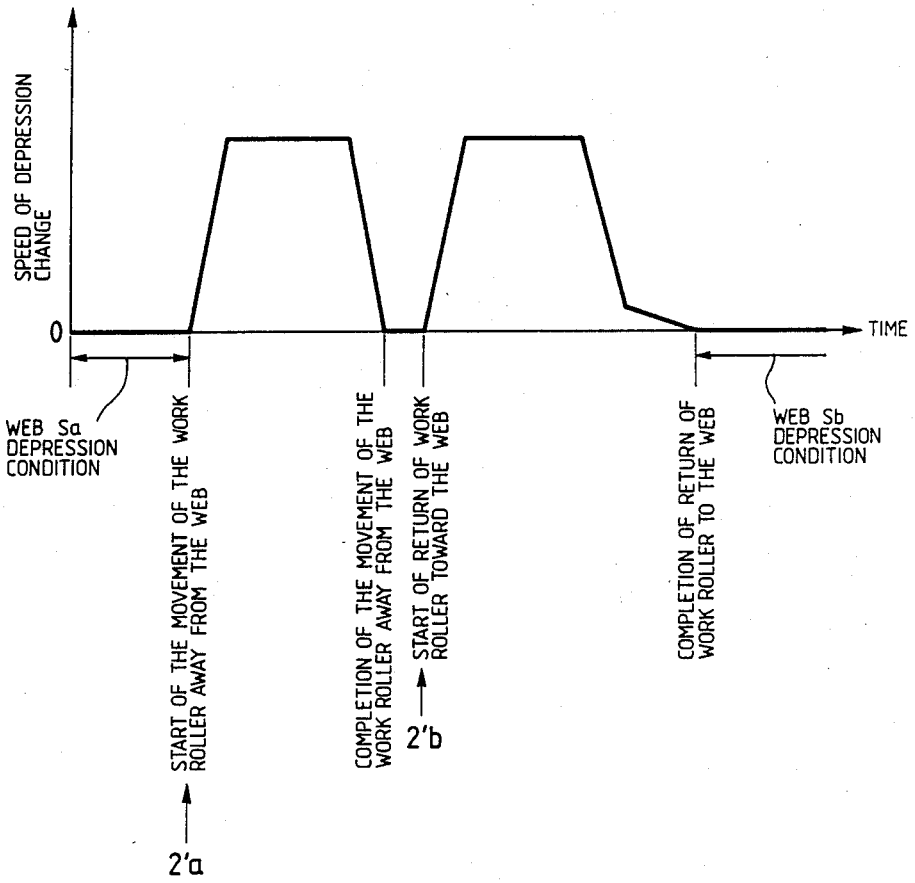
FIG. 5 is a graphical representation indicating adjustment variation with time in a depression control method for the roller leveler of FIG. 4.

FIG. 5 shows variation in adjustment of the lower work rollers in the device of FIG. 4. When the depression setting units 5, in which the adjustment data for the metal web Sa has been loaded, is informed of the arrival of the junction to the inlet of the roller leveler through the junction detecting unit 2'a, it will move the work rollers 100 mm away from the metal web. When the junction of the two metal webs 2a and 2b is detected by the junction detecting unit 2'b at the outlet of the roller leveler 6, the arithmetic unit 3 outputs an instruction signal so that the work rollers are returned to the original position, and the amount of adjustment of the work rollers is switched over to the amount of adjustment predetermined for the metal web Sb.

In this operation, if the work rollers are brought abruptly into contact with the metal web, then the web may be bent or the tension given to the metal web may be changed abruptly so that the junction may be broken. Therefore, it is preferable that the work rollers are returned slowly to their original position. Also, depending on the method of connecting the metal webs, the lower work rollers and/or the upper work rollers may be moved away from the metal web in the roller leveler.

In the above-described case, the metal webs are connected by the connecting unit 1; however, the device is operated in the same manner where the metal webs are connected by the operator.

As described above, in the second example of the roller leveler in accordance with the invention, the junction detecting units for detecting the junction of metal webs are arranged near the inlet and the outlet of the roller leveler, respectively. The arithmetic unit provides an instruction signal for moving the work rollers away from the metal web and instruction signal for changing the amount of adjustment in response to the output signals of the junction detecting units. The depression control unit controls the removal of the work rollers from the metal web and the amount of adjustment given to the plate according to the instruction signals. Therefore, the device substantially eliminates damage to the work rollers by the burrs and bent of the junction of metal web and chips formed when the metal webs are cut, and also eliminates damage to the surfaces of the metal web by chips stuck to the work rollers.

Furthermore, with the roller type leveler of the invention, the period in cleaning or replacing the work rollers is greatly reduced. Yield and productivity are greatly improved by the invention, especially with respect to refining aluminum web to form the supports of presensitized plates (PS plates) for lithographic printing plate.

The second example of the roller type leveler has been described with reference to the case where the metal webs are cut widthwise before being joined together; however, it should be noted that the invention should not be considered as limited thereby. That is, the device may be modified so that, as in the first example of the device, when the junction passes through the roller leveler, the work rollers are not moved away from the metal web, nd the amount of adjustment only is changed.

While the invention has been described above with respect to different embodiments, various modifications within the spirit of the invention will be apparent to ordinarily skilled artisans. Thus, the scope of the invention should be considered to be limited only by the appended claims which follow immediately.

What is claimed is:

1. A roller leveler for refining a metal web in a roller leveler line comprising:

a plurality of work rollers arranged on an upper side and a lower side of said web and arranged to bend said web in alternating directions;

a connecting unit located upstream of said roller for connecting consecutive metal webs and outputting a connecting completion signal;

junction position detecting means provided on a roller leveler path for outputting at least a first signal indicative of a position of a junction of said metal web on said path;

an arithmetic unit, responsive to said connecting completion signal so as to start said roller leveler line, and further responsive to said at least said first signal outputted from said junction detecting means, for providing a first instruction signal for changing an amount of adjustment given to said metal web by said roller leveler, wherein said amount of adjustment is calculated by said arithmetic unit in accordance with a material, thickness and width of said metal web; and a depression control unit for controlling said amount of adjustment in response to said first instruction signal provided by said arithmetic unit.

2. A leveler as claimed in claim 1, wherein said junction detecting means comprises a length measuring unit disposed between said connecting unit and said roller leveler, for measuring a distance between said roller leveler and the junction of consecutive metal webs, said length measuring unit outputs said first signal.

3. A leveler as claimed in claim 1, wherein said junction detecting means comprises first and second junction detecting units for detecting the junction of consecutive metal webs, said junction detecting units being arranged near an inlet and an outlet of said roller leveler, respectively and providing said first signal and a second signal indicative of positions of said metal web on said path.

4. A leveler as claimed in claim 1, wherein said arithmetic unit further provides a second instruction signal for moving said work rollers away from said metal web in response to said first signal output by said junction detecting means, and said depression control unit controls removal of said work rollers from said metal web and said amount of adjustment in response to said first and second instruction signals.

5. A leveler as claimed in claim 2, wherein said arithmetic unit further provides a second instruction signal for moving said work rollers away from said metal web in response to said first signal output by said length measuring unit, and said depression control unit controls the removal of said work rollers from said metal web and said amount of adjustment in response to said first and second instruction signals.

6. A leveler as claimed in claim 3, wherein said arithmetic unit further provides a second instruction signal for moving said work rollers from said metal web in response to said first and second signals output by said junction detecting units, and said depression control unit controls the removal of said work rollers from said metal web and said amount of adjustment in response to said first and second instruction signals.

7. An automatic depression control method for a roller leveler in a roller leveler line, comprising the following steps:

connecting consecutive metal webs and providing a connecting completion signal so as to start said roller level line;

detecting a position of a junction of metal web on a roller leveler path, and providing a detection signal accordingly;

calculating an amount of adjustment for work rollers of said roller leveler in accordance with a material, thickness and width of said metal web;

issuing a first instruction signal, for moving work rollers of said roller leveler away from said metal web in said roller leveler, to a depression control unit when the junction of metal web enters said roller leveler;

issuing a second instruction signal based on said calculation, for causing said work rollers to press said metal web with a predetermined amount of adjustment, to said depression control unit when said junction of metal web passes through said roller leveler;

wherein said depression control unit operates automatically in response to said first and second instruction signals.

8. A method as claimed in claim 7, wherein said detecting step is performed by position detecting means which comprises a length measuring unit provided between said roller leveler and a metal web connecting unit, for measuring a distance between said roller leveler and said junction of metal web.

9. A method as claimed in claim 7, wherein said detecting step is performed by position detecting means which comprises two junction detecting units disposed near an inlet and an outlet of said roller leveler, respectively, for detecting said junction of metal web.

* * * * *